US006311534B1

(12) United States Patent
Shah et al.

(10) Patent No.: US 6,311,534 B1
(45) Date of Patent: Nov. 6, 2001

(54) SHEET METAL BENDING APPARATUS

(75) Inventors: Ashok Shah, Naperville; Richard Blum, Bolingbrook, both of IL (US)

(73) Assignee: The Lockformer Company, Lisle, IL (US)

( * ) Notice: Subject to any disclaimer, the term of this patent is extended or adjusted under 35 U.S.C. 154(b) by 0 days.

(21) Appl. No.: 09/482,876

(22) Filed: Jan. 14, 2000

(51) Int. Cl.[7] ..... B21D 5/08; B21B 31/18
(52) U.S. Cl. ..... 72/181; 72/247
(58) Field of Search ..... 72/179–182, 247; 492/39, 40

(56) References Cited

U.S. PATENT DOCUMENTS

| | | | | |
|---|---|---|---|---|
| 851,451 | * | 4/1907 | Steiber | 72/247 |
| 865,908 | * | 9/1907 | Johnson | 72/181 |
| 1,078,240 | * | 11/1913 | Barbour | 72/247 |
| 4,269,055 | * | 5/1981 | Sivachenko | 72/181 |
| 4,526,024 | * | 7/1985 | Toti | 72/181 |
| 4,899,566 | * | 2/1990 | Knudson | 72/247 |
| 5,394,722 | * | 3/1995 | Meyer | 72/181 |
| 5,735,788 | * | 4/1998 | Yasutake | 492/39 |

FOREIGN PATENT DOCUMENTS

| | | | | |
|---|---|---|---|---|
| 47-37833 | * | 9/1972 | (JP) | 72/181 |

* cited by examiner

*Primary Examiner*—Daniel C. Crane

(57) ABSTRACT

A roll forming apparatus is provided having a plurality of roll forming stations arranged in an advancing path and having at least one roll forming station including adjustable top and bottom rolls. The adjustable forming rolls include separate inner and outer sections. The inner roll sections are adjustable transverse to the advancing path in order to shift the position of bend introduction to a workpiece. In a preferred embodiment, each inner roll section cooperates with a backing collar which has preset stops of different heights to quickly and precisely adjust the apparatus to predetermined settings. The apparatus is particularly useful for forming flanges on duct sections where duct sections having different flange heights are desired. The at least one adjustable roll forming station can be used to retrofit existing non-adjustable roll forming apparatus.

26 Claims, 5 Drawing Sheets

SHEET METAL BENDING APPARATUS

FIELD OF THE INVENTION

The present invention relates to a metal bending apparatus. More particularly, the invention relates to a novel roll forming apparatus which is adjustable to produce articles having different dimensions.

BACKGROUND OF THE INVENTION

Roll forming machines for bending sheet metal are well known in the art. They are useful for fabricating a variety of metal products including sheet metal ducts and connectors.

Roll forming machines generally include a series of forming rolls arranged in successive forming stations along an advancing path. In operation, a piece of sheet metal is passed between top and bottom rolls of each successive forming station, wherein each forming station introduces an additional degree of bending to the metal until a desired cumulative bend in the metal is complete. U.S. Pat. No. 4,045,989 describes a roll forming machine of this type and is incorporated herein by reference.

Numerous structural variations in roll forming machines are available depending on the particular bending operation desired. For example, the number and size of the forming stations can be varied to produce the particular bent metal product desired. Various modified forming stations can also be included according to specific applications. For example, U.S. Pat. No. 4,045,989, mentioned above, describes a roll forming machine, having a first forming station which recognizes notches in the edge of a metal workpiece and thereby introduces bends to predetermined alternating metal sections between the notches. It is also known to include an idler assembly as a station along the advancing path of a roll forming machine.

The present invention is useful for any roll forming application in which it is desired to periodically make adjustments to the dimensions between the bends being made.

In the case of duct fabrication, ducts are generally produced in sections which are subsequently connected at their ends by appropriate fastening means. In order to produce the desired connections between duct sections, each duct section can be provided with roll formed hems or flanges at both ends which abut and register with corresponding structures on adjacent sections when connected. The hems or flanges are joined together, for example by cleats or corner connectors. A representative example of a duct connection system is illustrated in FIGS. 1 and 2.

U.S. Pat. No. 4,466,641 describes a duct connecting system of this type, known as the Transverse Duct Connector (TDC) system, which utilizes roll formed flanges on the ends of duct sections defining frames which are unitary or integral to the duct walls. In a preferred form of this system, upper and lower channels are formed in the flanges for receiving the edges of a corner connector. The TDC system, marketed by The Lockformer Company and Iowa Precision Industries, Inc., permits rapid connection of duct sections by snapping corner connectors into the frames and bolting the duct sections together across adjoining frames to produce a duct having superior strength. U.S. Pat. No. 4,579,375 also describes a duct connection system utilizing duct sections having integral frames.

There is a need for a more versatile roll forming machine which can easily be reset to make bends of different dimensions. For example, when forming duct sections using existing roll forming technology, the integral frames are formed of flanges having a particular fixed height. However, when ducts made from different metal weights are fabricated, correspondingly different heights of flanges are often used. In order to convert roll forming production to make duct sections having a different flange height, the apparatus must be retooled with a new outboard set of forming station rolls if possible, or if not, an altogether different machine must be used. The cost in terms of time and equipment to make the necessary adjustments, if such are feasible, can be significant. The present invention addresses these and other needs.

The roll forming apparatus of the present invention, while generally applicable to bending operations, is particularly useful for fabricating duct sections for use in these and other types of duct manufacturing systems.

OBJECTS AND SUMMARY OF THE INVENTION

Therefore, it is a primary object of the present invention to provide an improved roll forming apparatus.

Another primary object of the present invention is to provide a roll forming apparatus which is adjustable to produce bends of different dimensions.

Another object of the present invention is to provide a roll forming apparatus having adjustable roll forming stations.

Another object of the present invention is to provide a roll forming apparatus which is quickly and easily adjustable and avoids the need for expensive and time consuming retooling operations.

Another object of the present invention is to provide a roll forming apparatus having forming stations capable of being quickly adjusted between several predetermined settings.

Another object of the present invention is to provide a roll forming apparatus which can be easily adjusted to produce duct flanges of various different predetermined heights.

Another object of the present invention is to provide an adjustable forming roll and rollset which can be installed to retrofit existing non-adjustable roll forming apparatus.

These and other objects are realized by a novel roll forming station, rollset and machine including at least one forming station having top and bottom rolls including separate inner and outer sections. The effective dimensions of the rolls are adjustable by changing the distance between the inner and outer roll sections.

In a preferred embodiment of the invention, at least one forming station includes inner roll sections which are axially movable in a dimension transverse to the metal advancing direction and parallel to the drive shafts. Thereby, the position of a bend on a workpiece can be adjusted. Any suitable mechanism can be provided for securing the forming rolls in a selected operating position. Preferably, indexing means are also provided for accurately and reproducibly adjusting the inner roll sections between predetermined settings. For example, a system of adjustable stops can be provided to variably limit the axial travel of the forming roll inner sections. This makes adjusting the rolls to frequently used settings fast and easy and avoids the need for fine tuning when resetting for a different bend dimension.

Frequently, a bend is introduced to a workpiece cumulatively by successive forming stations. Accordingly, the present invention provides an adjustable rollset including more than one adjustable forming station. Indexing means insure that each forming station of the rollset can be reproducibly adjusted to predetermined settings such that all are accurately coordinated to one another in each operating setting.

The present invention can also include further components which are adjustable in coordination with the settings of the adjustable inner roll sections. For example, in a roll forming apparatus having an idler assembly, the idler can be axially adjustable to accommodate A the operating settings of adjacent adjustable forming stations.

The present invention is particularly useful for forming duct flanges of different heights and is generally applicable to formation of all duct flange structures, including those described in the U.S. Pat. Nos. 4,466,641 and 4,579,375, discussed above. The present invention is also generally useful for any other roll forming application.

BRIEF DESCRIPTION OF THE DRAWINGS

The foregoing summary, as well as the following detailed description of the preferred embodiments of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION AND PRESENTLY PREFERRED EMBODIMENTS

Figure 1:
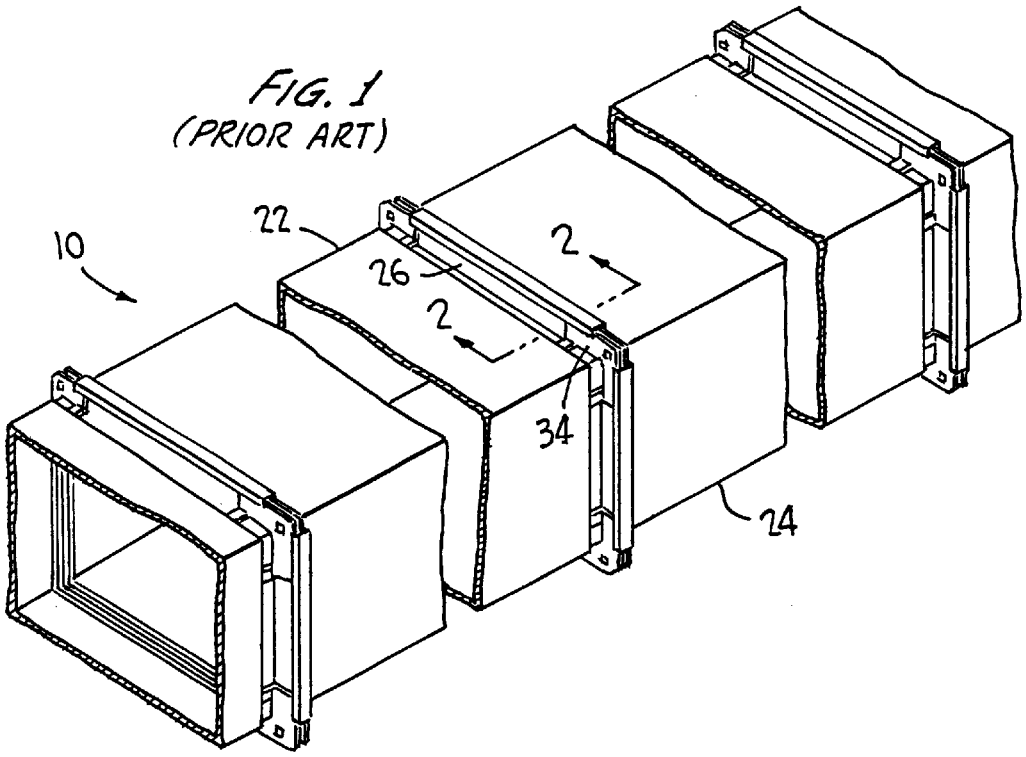
FIG. 1 (PRIOR ART)
FIG. 1 is fragmentary perspective of a duct having sections joined at integral flanges.
Figure 2:
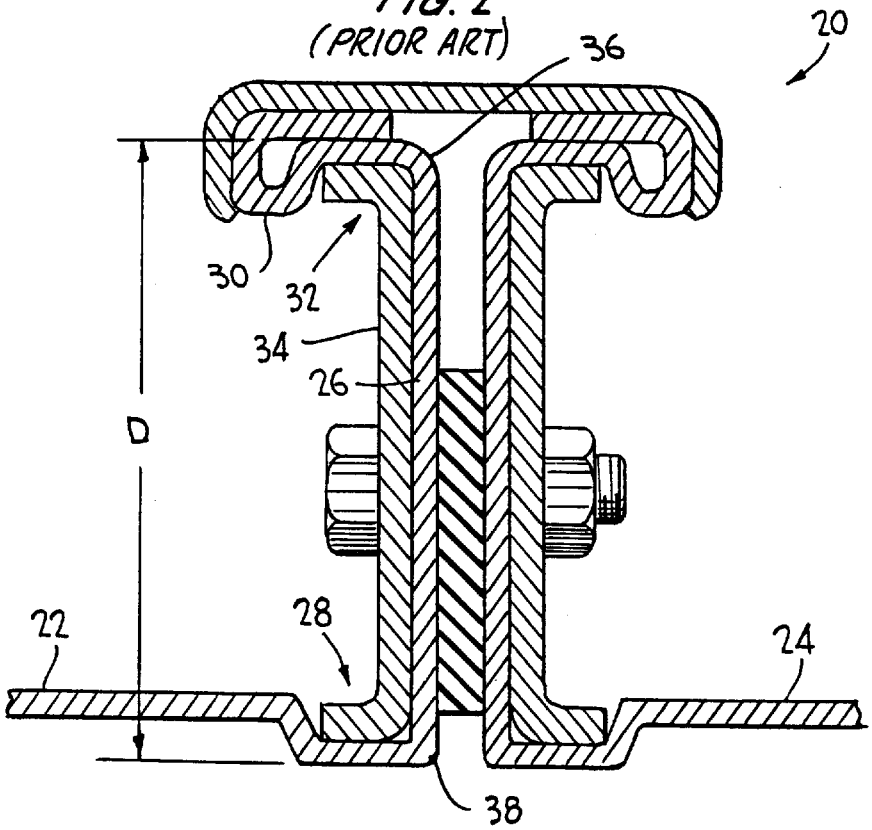
FIG. 2 (PRIOR ART)
FIG. 2 is a cross section along line 2—2 of FIG. 1.

Referring to FIGS. 1 and 2, prior art duct 10 and duct joint 20 are shown, respectively. Duct joint 20 illustrates a duct connection wherein ducts or duct segments 22 and 24 are connected at their respective transverse ends. Duct segment 22 has roll formed upturned portion or flange 26 including channel 28 and bead 30 defining a second channel 32. The height of flange 26 is determined by the distance D between channels 28 and 32. Corner connector 34 is received by flange 26. In order to form duct flanges having different profile heights, the distance D can be adjusted by changing the position of bend 36 in relation to bend 38. The preferred embodiment of the present invention can be used to make duct sections of this or any other type wherein periodic adjustment of the bend dimensions is desired.

Figure 3:
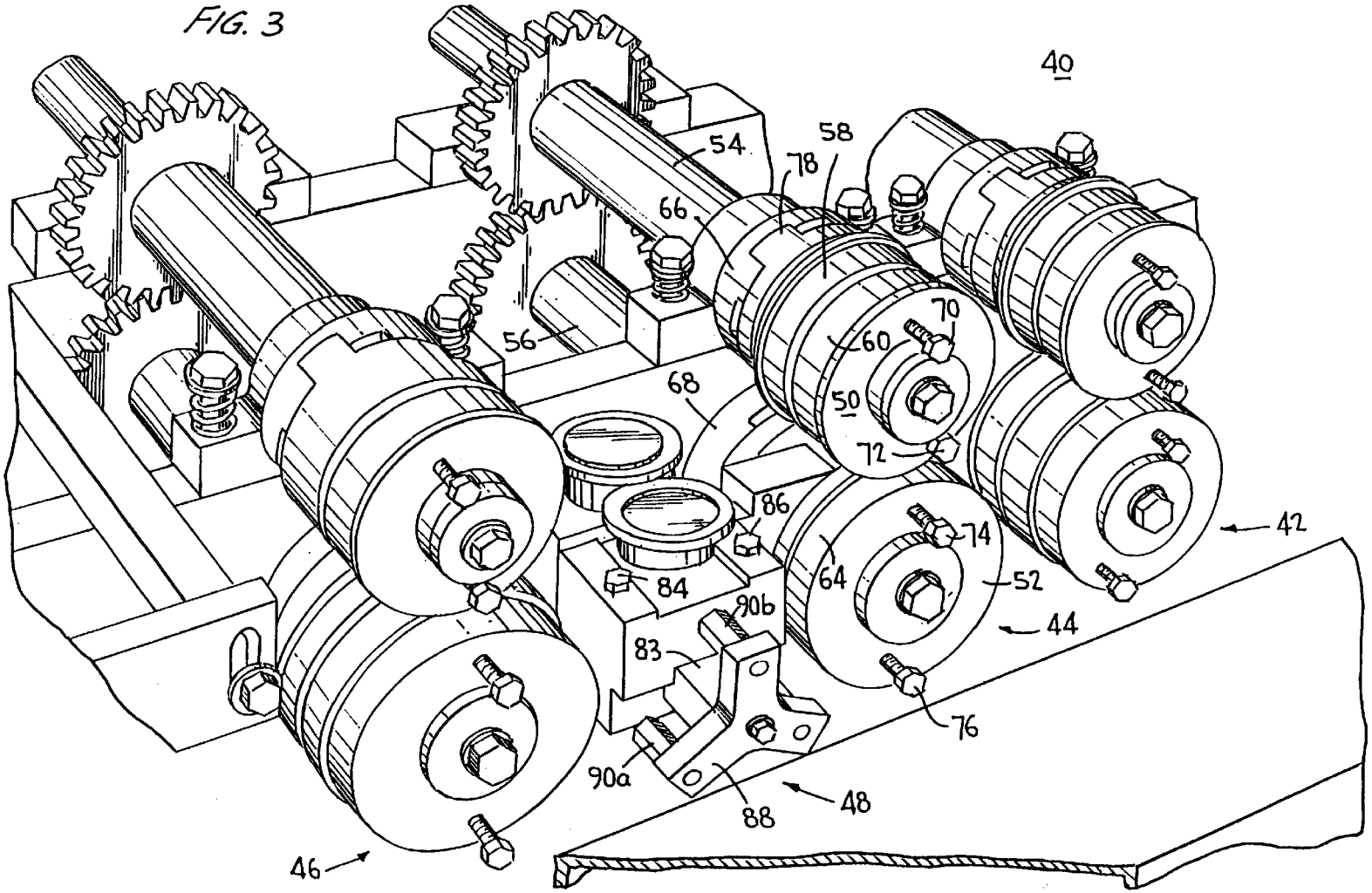
FIG. 3 is a fragmentary perspective of a roll forming apparatus according to the present invention.

Referring now to FIG. 3, roll forming apparatus 40 embodies the presently preferred manner of practicing the invention. While not necessary or limiting to the invention, rollformer 40 includes a total of fourteen forming stations, wherein the second through sixth stations are individually adjustable in order to provide different duct flange heights. Thus, FIG. 3 is a fragmentary view showing the fourth, fifth and sixth forming stations designated 42, 44 and 46, respectively. FIG. 3 also shows idler assembly 48 which is axially adjustable to register with the available positions of the forming stations. Also not necessary or limiting to the invention, the adjustable forming stations of rollformer 40 are each constructed to move between each of three preset flange height settings, as described in greater detail hereafter.

Figure 7:
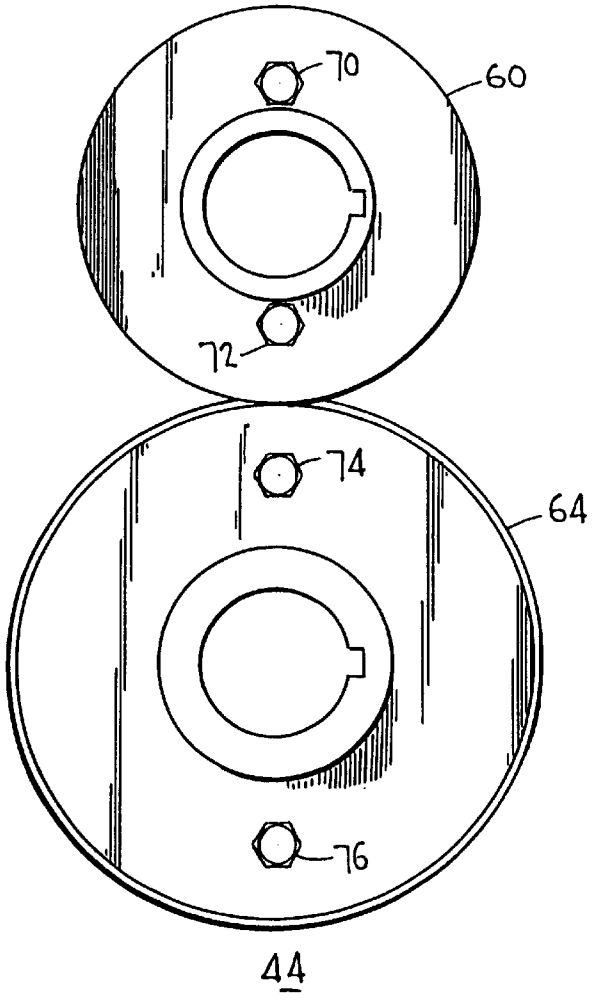
FIG. 7 is a front view of the forming station of FIG. 6.
Figure 6:
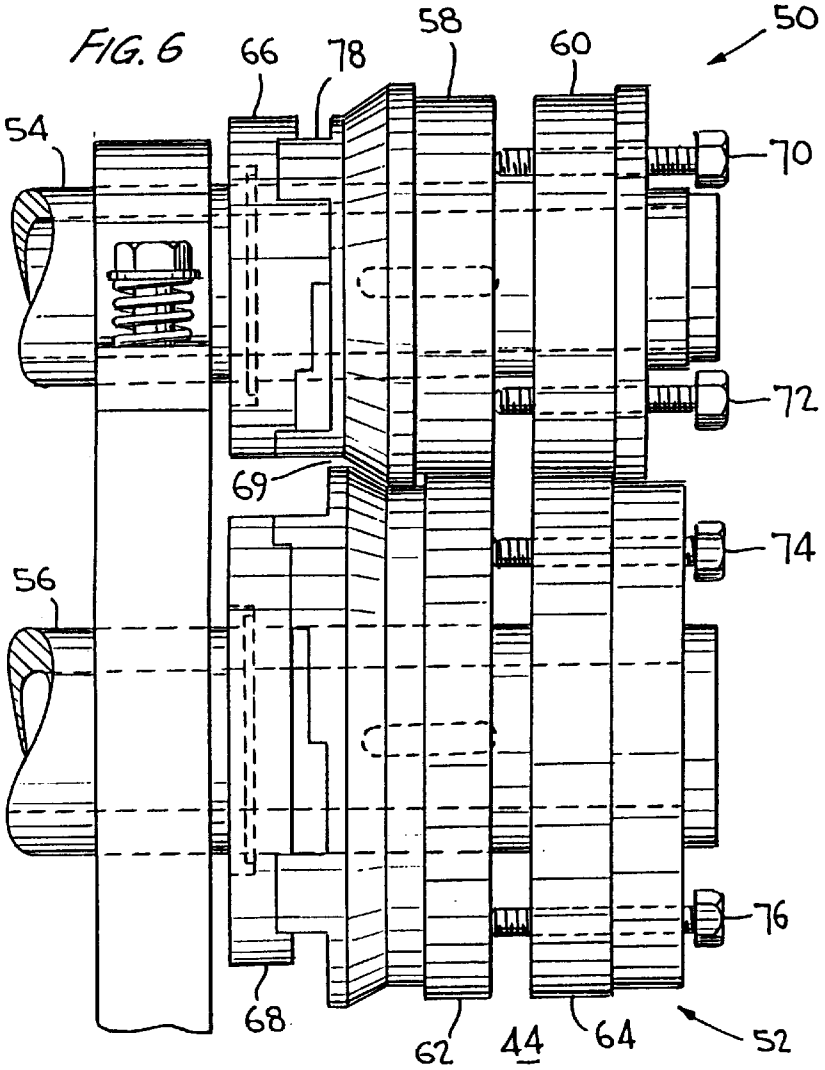
FIG. 6 is a side view of a forming station according to the present invention.
Figure 9:
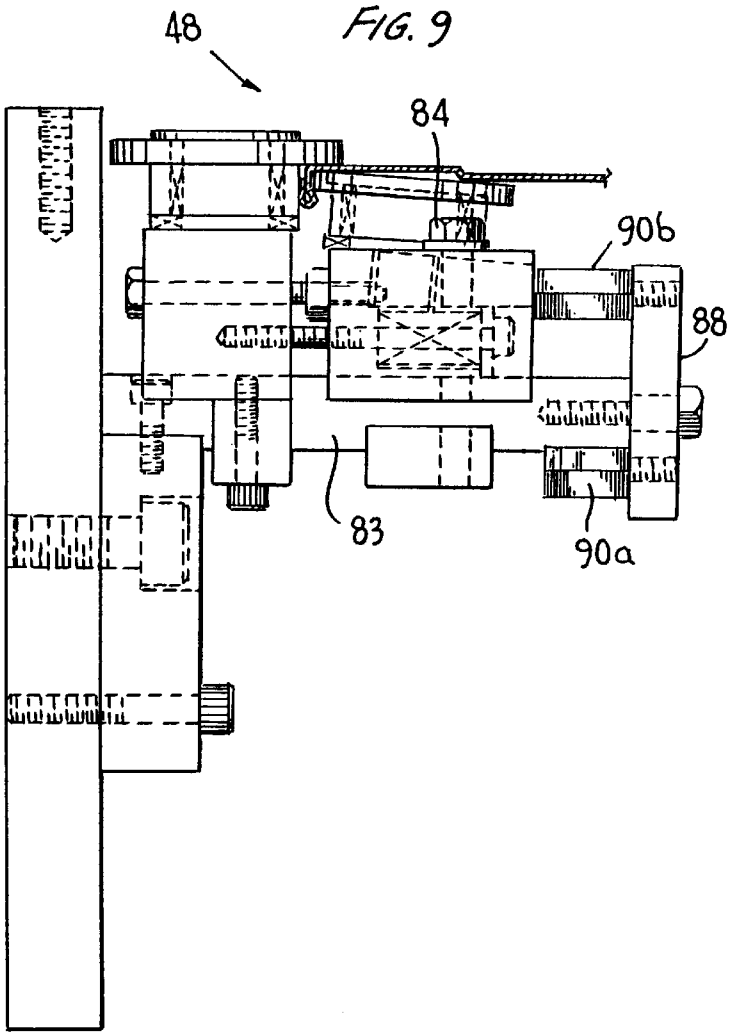
FIG. 9 is a side view of the idler assembly of FIG. 8.
Figure 8:
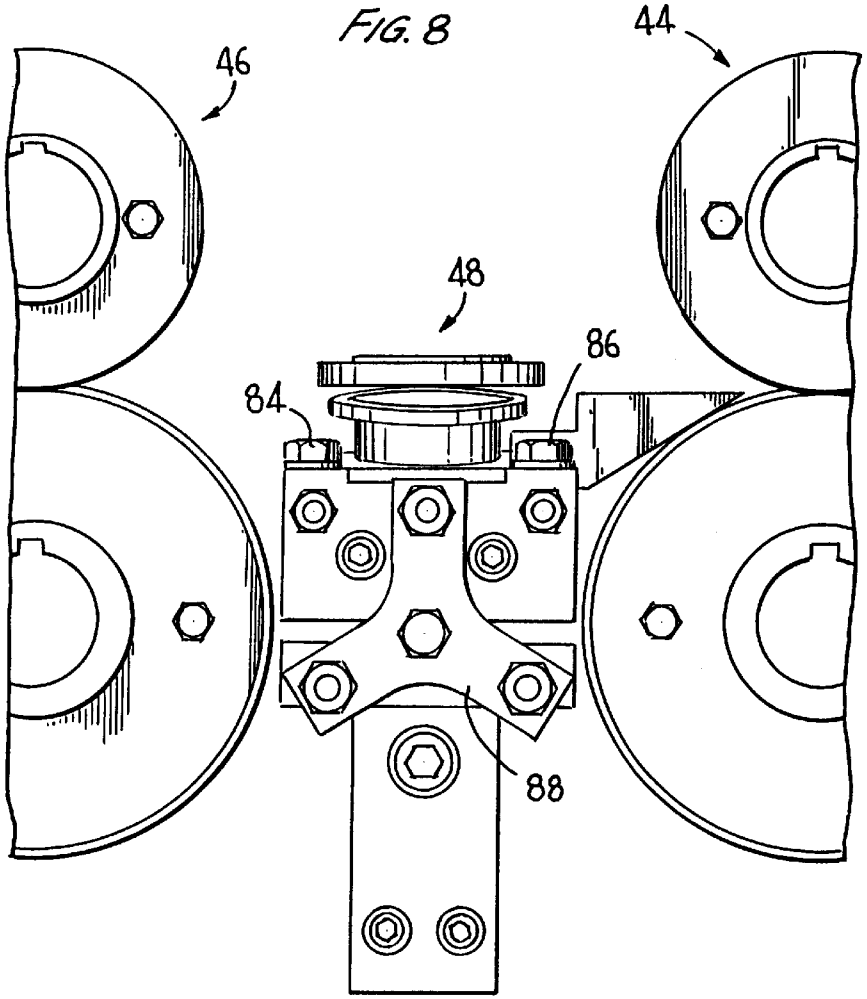
FIG. 8 is a front view of an idler assembly according to the present invention.

Referring to FIGS. 3, 6 and 7, roll forming station 44 is representative of the adjustable forming stations of rollformer 40. Station 44 has top roll 50 and bottom roll 52, located on drive shafts 54 and 56, respectively. Roll 50 has inner section 58 and outer section 60. Roll 52 has inner section 62 and outer section 64. Inner roll sections 58 and 62 define a bending region 69 and are adjacent to backing collars 66 and 68, respectively.

Adjustability of station 44 is provided by inner roll sections 58 and 62, which are axially slidable as a unit on their respective drive shafts thereby changing the axial position of bending region 69. Bolts 70, 72, 74 and 76 secure the roll sections in desired operating settings and must be loosened in order to reposition the unit of inner roll sections 58 and 62. Forming rolls 50 and 52 preferably are prevented from rotation in relation to their respective drive shafts by any suitable means.

Figure 4:
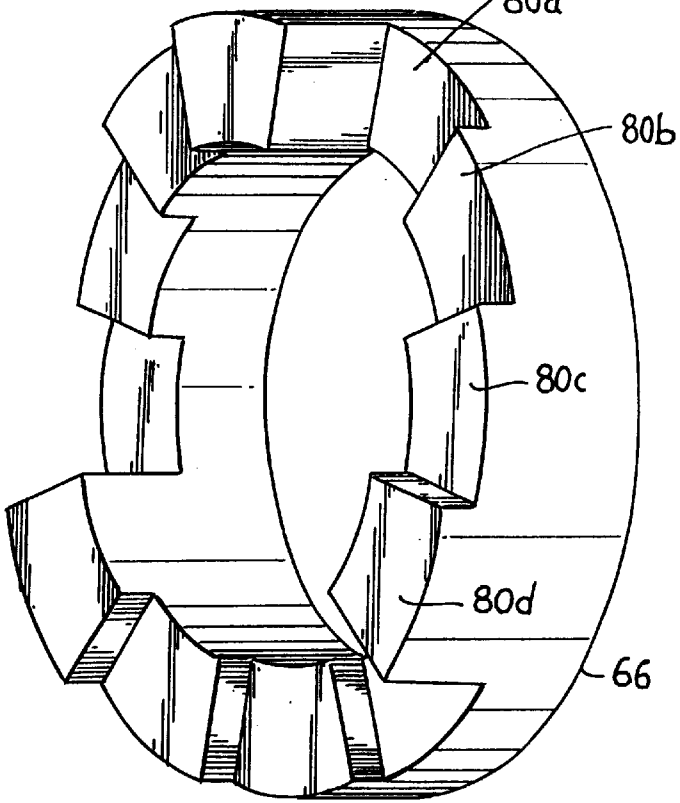
FIG. 4 is a backing collar according to the present invention.
Figure 5:
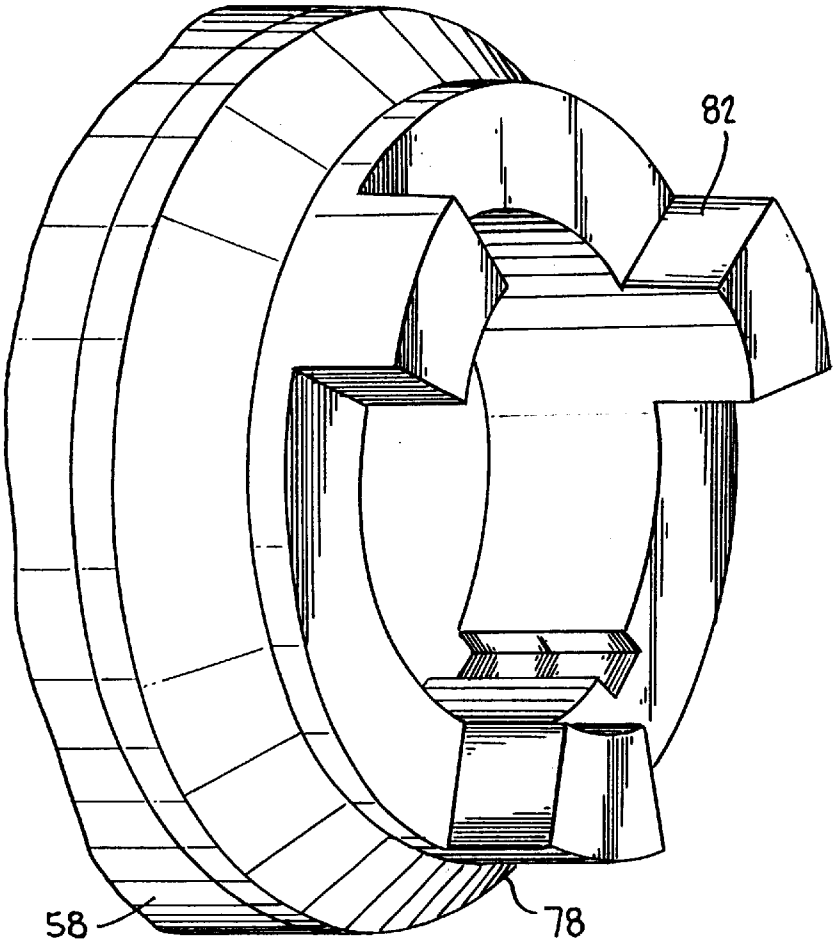
FIG. 5 is a perspective of a rear portion of a form roll inner section according to the present invention.

In order to provide accurate and easily reproducible roll settings, station 44 preferably includes suitable means to secure inner roll sections 58 and 62 in different predetermined operating positions or settings. Therefore, the preferred embodiment includes a rotatable backing collar having a series of stops corresponding to preselected operating positions. Referring to FIGS. 4, 5 and 6 there is shown rotatable backing collar 66 which cooperates with a rear face 78 of inner roll section 58. Collar 66 has a stepped profile including three repeating sets of three steps each, 80*a*–80*c*, and upper platform 80*d*. As seen in FIG. 6, collar 66 has a mating interaction with rear face 78, which has three evenly spaced teeth 82. Steps 80*a*–80*c* provide alternate stops against which teeth 82 will selectively abut according to the rotational position of backing collar 66. In the presently preferred embodiment, for example, backing collar 66 is provided with steps 80*a*–80*c*, wherein each successive step is 5 millimeters higher than the last. This configuration can be employed to fabricate duct flanges of 25, 30 and 35 millimeter heights, respectively.

When bolts 70, 72, 74 and 76 are loosened, inner sections 58 and 62 can be moved away from backing collar 66. This allows collar 66 to be freely rotated to any desired position for reinsertion of teeth 82 to contact steps 80*a*, 80*b* or 80*c*. It will be appreciated that the steps provide an indexing function by allowing rapid reproducible resetting of the apparatus according to the dimensions of the backing collar steps. All of the adjustable roll forming stations of the apparatus are preferably constructed to provide identical backing collar settings in order to form a compatible set of forming stations which adjust in the same amounts to provide a desired bend at a desired location on a workpiece.

The final forming station (not shown) of rollformer 40 is preferably provided with a different bottom roll corresponding to each different operating setting of the adjustable forming stations. Upon resetting the rolls, the final bottom roll is replaced in order to properly square the final form of a duct flange.

The preferred embodiment also includes optional idler assembly 48, which is axially adjustable along track 83 to register properly with the forming roll settings. In the preferred embodiment, lockup bolts 84 and 86 secure assembly 48 in its operating positions and can be loosened in order to axially move the assembly. Dial 88 has three stops

90*a*–90*c* (90*c* not shown) of different predetermined lengths which correspond respectively to the available forming station settings 80*a*–80*c*. Dial 88 can be rotated to determine which stop is in the top position to act on assembly 48. Stops 90*a*–90*c* limit the axial travel of assembly 48 to three different predetermined settings, respectively, depending on the position of dial 88.

It will be appreciated that rollformer 40 is an example of the preferred embodiment as applied to a specific roll forming operation. However, the basic structure of adjustable rollforming station 44 is generally applicable. Further, various modifications of this basic structure are available in accordance with the present invention.

For example, the number of adjustable forming stations is a matter of preference based on the particular bending application. Further, there are various means to provide a forming station with indexing means or discreet preset stops. Thus, the number and location of the teeth and stops is a matter of preference according to particular situations. The resetting mechanism itself can be inverted such that the rear faces of the inner forming roll sections have stepped profiles and the backing collars have teeth. The backing collars can be removable and replaceable to increase versatility. Further, operating settings need not be limited to discreet stops. A backing collar can have a sloped profile providing an infinite number of operating settings. The foregoing are only examples of modifications being within the ability of one skilled in the art which form a part of the present invention and are embraced by the appended claims.

It is claimed:

1. An apparatus for bending a metal sheet comprising:

a series of forming stations arranged along an advancing path such that each successive station is capable of introducing an incremental bend to said metal;

at least one of said forming stations is an adjustable station including a top form roll and a bottom form roll arranged for rotation about first and second parallel axes, respectively, said axes being perpendicular to said advancing path;

each said top form roll and said bottom form roll of said at least one adjustable station includes an outer roll section and an inner roll section, said top and bottom outer roll sections together define an outer complementary pair;

said top and bottom inner roll sections together define an inner complementary pair and a bending region therebetween;

each said inner roll section includes an inner and an outer vertical face with said outer vertical face constructed and arranged to be substantially adjacent to said outer roll section;

said inner complementary pair is movable relative to said outer complementary pair in a dimension parallel to said axes, and at least one backing collar, rotatable about said axis and constructed and arranged substantially adjacent to said inner vertical face of said inner roll section to adjust the distance between said backing collar and said inner vertical face.

2. The apparatus of claim 1, further comprising first and second backing collars, each arranged substantially adjacent to one said inner vertical face.

3. The apparatus of claim 2, wherein said first and second backing collars are rotatable about said first and second axes, respectively.

4. The apparatus of claim 3, wherein each said inner vertical face further comprises at least one protruding tooth and each said backing collar further comprises at least one stop surface arranged to contact a respective said at least one tooth and to limit the travel of said inner complementary pair.

5. The apparatus of claim 4, wherein each said inner vertical face includes three said teeth evenly spaced from one another.

6. The apparatus of claim 4, wherein each said backing collar includes at least two said stop surface, each said surface of a different height and arranged to cooperate with said at least one tooth.

7. The apparatus of claim 1, further comprising at least one upper locking bolt connecting said top form roll inner and outer sections and at least one lower locking bolt connecting said bottom form roll inner and outer sections.

8. The apparatus of claim 1, wherein said series of forming stations includes at least two adjustable stations.

9. The apparatus of claim 1, wherein the last of said forming stations along said advancing path includes a replaceable bottom form roll.

10. The apparatus of claim 1, further comprising at least one adjustable idler assembly.

11. The apparatus of claim 10, wherein said idler assembly is movable on a track in a dimension parallel to said axes.

12. The apparatus of claim 11, further comprising at least one stop arranged to limit travel of said idler assembly.

13. An adjustable roll forming station comprising a top form roll and a bottom form roll arranged for rotation about first and second parallel axes, respectively, said axes being perpendicular to an advancing path;

each said top form roll and said bottom form roll includes an outer section and an inner section, said top and bottom outer sections together define an outer complementary pair;

said inner sections together define an inner complementary pair and a bending region therebetween;

said inner complementary pair is movable relative to said outer complementary pair in a dimension parallel to said axes;

each said inner roll section includes an inner and an outer vertical face with said outer vertical face constructed and arranged to be substantially adjacent to said outer section; and at least one backing collar rotatable about said axis and constructed and arranged substantially adjacent to one said inner vertical face of said inner roll section to adjust the distance between said backing collar and said inner vertical face.

14. A method of utilizing the roll forming station of claim 13 comprising:

passing a first piece of sheet metal through said bending region to introduce a first bend in said first piece;

adjusting said inner complementary pair along said axes;

passing a second piece of sheet metal through said bending region to introduce a second bend in said second piece.

15. The adjustable roll forming station of claim 13, further comprising first and second backing collars, each arranged substantially adjacent to one said inner vertical face.

16. The adjustable roll forming station of claim 15, wherein said first and second backing collars are rotatable about said first and second axes, respectively.

17. The adjustable roll forming station of claim 16, wherein each said inner vertical face further comprises at least one protruding tooth and each said backing collar further comprises at least one stop surface arranged to contact a respective said at least one tooth and to limit the travel of said inner complementary pair.

18. The adjustable roll forming station of claim 17, wherein each said inner vertical face includes three said teeth evenly spaced from one another.

19. The adjustable roll forming station of claim 17, where each said backing collar includes at least two said stop surface, each said surface of a different height and arranged to cooperate with said at least one tooth.

20. The adjustable roll forming station of claim 13, further comprising at least one upper locking bolt connecting said top form roll inner and outer sections and at least one lower locking bolt connecting said bottom form roll inner and outer sections.

21. A forming roll comprising:

an outer roll section; an inner roll section; a backing collar;

said inner roll section, said outer roll section and said backing collar being arranged to rotate about an axis;

said inner roll section being arranged along said axis between said outer roll section and said backing collar;

said inner roll section being adjustable along said axis relative to said outer roll section and said backing collar;

said inner roll section abuts said backing collar in a limiting interaction to limit the extent of said adjustment of said inner roll section;

said backing collar being rotatable about said axis independent of said inner roll section to adjust the position of said inner roll section where said limiting interaction occurs.

22. The forming roll of claim 18, further comprising first and second backing collars, each arranged substantially adjacent to one said inner vertical face.

23. The forming roll of claim 22, wherein said first and second backing collars are rotatable about said first and second axes, respectively.

24. The forming roll of claim 23, wherein each said inner vertical face further comprises at least one protruding tooth and each said backing collar further comprises at least one stop surface arranged to contact a respective said at least one tooth and to limit the travel of said inner complementary pair.

25. The forming roll of claim 24, wherein each said inner vertical face includes three said teeth evenly spaced from one another.

26. The forming roll of claim 25, where each said backing collar includes at least two said stop surface, each said surface of a different height and arranged to cooperate with said at least one tooth.

* * * * *

UNITED STATES PATENT AND TRADEMARK OFFICE

CERTIFICATE OF CORRECTION

PATENT NO. : 6,311,534 B1
DATED : November 6, 2001
INVENTOR(S) : Ashok Shah et al.

It is certified that error appears in the above-identified patent and that said Letters Patent is hereby corrected as shown below:

Column 8,
Line 8, “claim 18” should read -- claim 21 --;
Line 22, “claim 25” should read -- claim 24 --.

Signed and Sealed this

Eleventh Day of June, 2002

*Attest:*

*Attesting Officer*

JAMES E. ROGAN
*Director of the United States Patent and Trademark Office*